US005402736A

United States Patent [19]

Dausch

[11] Patent Number: 5,402,736

[45] Date of Patent: Apr. 4, 1995

[54] TABLE HAVING A TABLETOP ADJUSTABLE TO SELECTABLE LEVELS

[76] Inventor: George Dausch, 126 E. Ruelle, Mandeville, La. 70448

[21] Appl. No.: 132,880

[22] Filed: Oct. 7, 1993

[51] Int. Cl.[6] ..... A47B 9/00

[52] U.S. Cl. ..... 100/144; 108/147; 248/162.1

[58] Field of Search ..... 108/148, 144, 146, 147, 108/106; 248/648, 162.1, 157, 188.1, 188.2

[56] References Cited

U.S. PATENT DOCUMENTS

| | | | |
|---|---|---|---|
| 4,619,208 | 10/1986 | Kurrasch | 108/144 |
| 4,651,652 | 3/1987 | Wyckoff | 108/144 |
| 4,667,605 | 5/1987 | Bastian | 108/144 |
| 5,289,782 | 3/1994 | Rizzi et al. | 108/146 X |

FOREIGN PATENT DOCUMENTS

| | | | |
|---|---|---|---|
| 2836134 | 2/1980 | Germany | 108/144 |
| 2095542 | 10/1982 | United Kingdom | 108/144 |

*Primary Examiner*—Jose V. Chen

*Attorney, Agent, or Firm*—Nicholas J. Garofalo

[57] ABSTRACT

A table unit having a tabletop which is subject, upon being manually released from a locked condition, to being raised relative to a base portion of the unit to a selectable level under pressure of weights constantly urging it upwards, and is subject to being manually relocked against pressure of the weights upon reaching a selected level; and the tabletop is subject to being lowered from an elevated level upon manually releasing its locked condition and exerting a downward pressure upon it overbalancing the upward pressure of the weights.

7 Claims, 4 Drawing Sheets

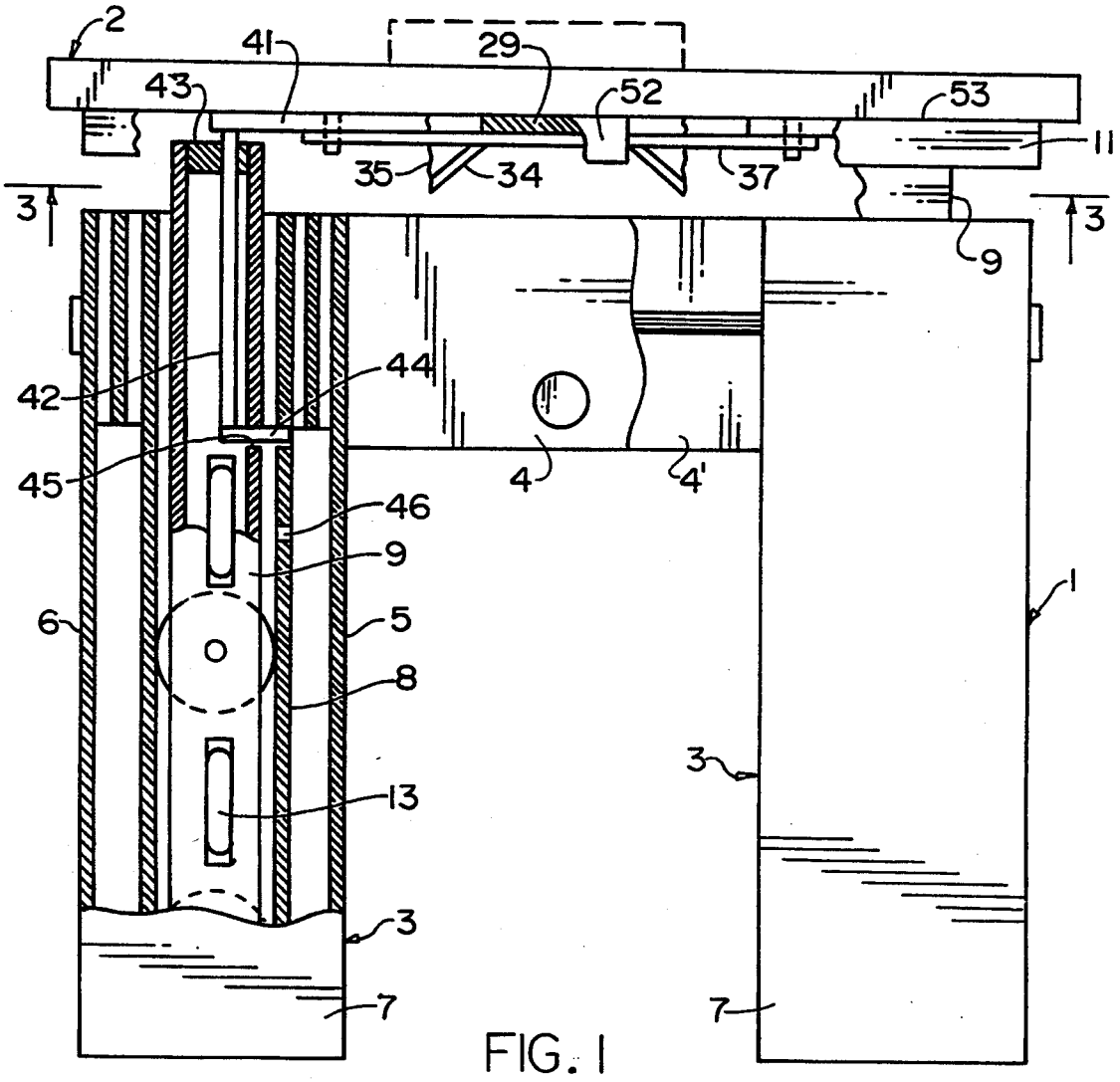
FIG. 1
FIG. 5
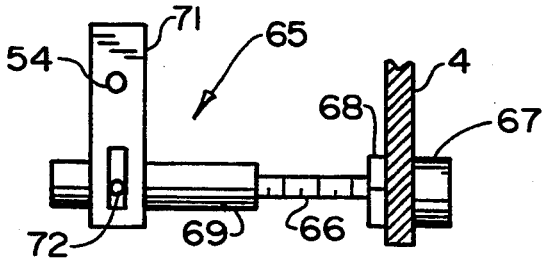

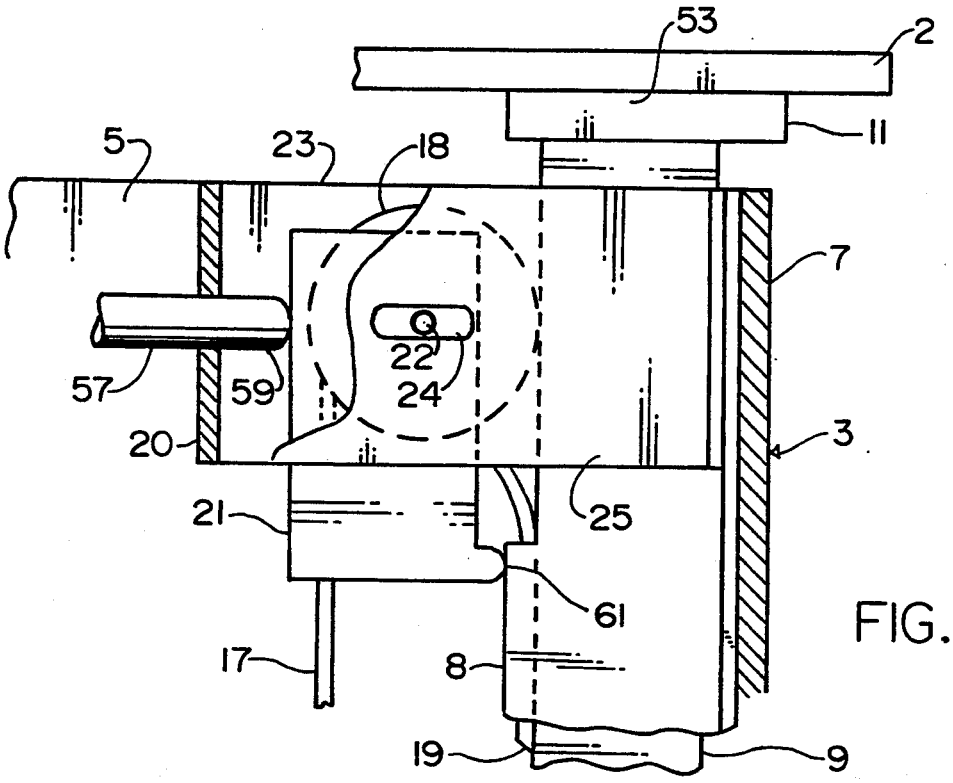
FIG. 7
FIG. 2
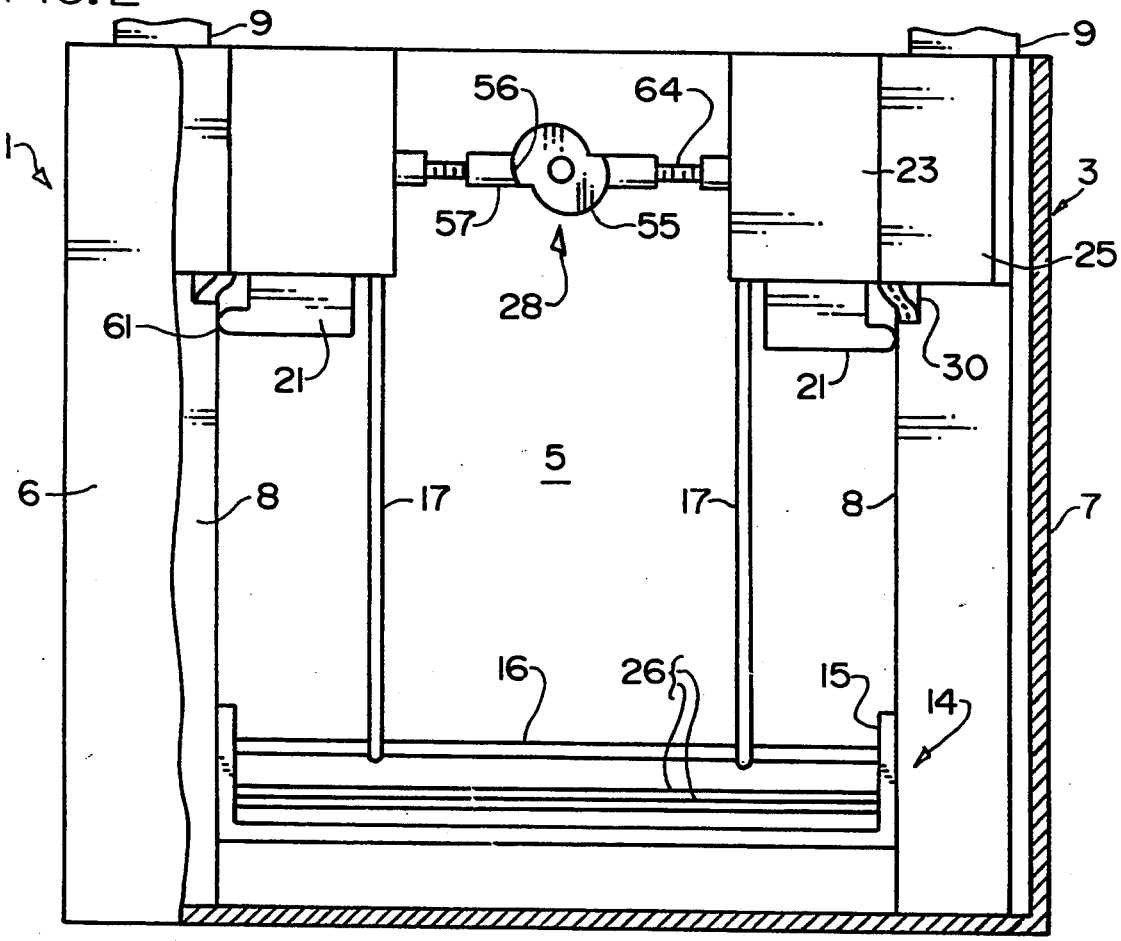

TABLE HAVING A TABLETOP ADJUSTABLE TO SELECTABLE LEVELS

BRIEF BACKGROUND AND SUMMARY OF THE INVENTION

This invention is directed to a table the tabletop of which may be adjustably raised to a selectable level so as to enable the convenient operation by a worker seated at the table of apparatus resting upon the tabletop. While a table embodying the invention may be suited for various uses, it is of special advantage in its use as a table for office appliances, such as computers, typewriters and other office machines.

Nature has not been uniform as to the height that it has given to humans. They vary in size. But office tables, at which many of them are seated in their work, appear to be of uniform height, normally approximately thirty inches. It is true that an office machine resting upon a conventional table may be at a suitable level for its convenient operation by some workers seated at the table, but it may be located too low for its convenient operation by many others. And where the table level of a machine is at an undesirable height to enable its convenient operation, the worker finds its operation to be tiresome, loses interest and, in due time, occurs mistakes in its operation.

The present invention overcomes these problems, it provides a table the tabletop of which may be readily adjusted in an easy manner to a level desired by a worker seated at the table for the convenient operation of a device upon the table. A table unit embodying the invention is of simple structure, inexpensive to produce, and practical for the purposes intended for it.

Briefly, a table unit embodying the invention has a base serving as a support for a tabletop that is adapted to be adjusted to a selectable level relative to the base. The base includes as its sides a pair of hollow footings or blocks which are bridged in parallel spaced relation to each other by rails. The tabletop is mounted upon the base by means of four corner legs which are slidable in the blocks to elevate the tabletop to selectable levels. Trays in the interior of the blocks of the base are associated by pulley and cable means with the legs, whereby the legs and tabletop are subject to being elevated from or lowered upon the base accordingly as the trays are loaded with weights. The trays are normally loaded with weights forcing the tabletop upwards. Manipulative means at the underside of the tabletop serves to associate the legs by locking means with the base, whereby the legs and tabletop are subject to being locked at a selected level against upward movement from such level relative to the base. And, to avoid an abrupt elevating movement of the legs and tabletop occurring under pressure of the weighted trays upon release of the locking means, manipulative means is provided to cam the legs under a friction pressure sufficient to obtain a slow elevating movement of the legs and tabletop upon release of the locking means.

In the accompanying drawing:

FIG. 1 is is an elevation view from the front end of a table unit embodying the invention; it shows the tabletop of the unit as slightly raised from the base of the unit; and it shows the front end wall of one of the block footings of the unit broken away;

FIG. 2 is a view of the left side of FIG. 1 in which view the tabletop and the outer side wall of the left block footing have been broken away;

FIG. 5 is a detail view of the manually operable means controling actuation of the camming means;

FIG. 7 is a side view of FIG. 6 with a portion of the tabletop positioned upon the related leg.

DETAILED DESCRIPTION OF THE INVENTION

Figure 3:
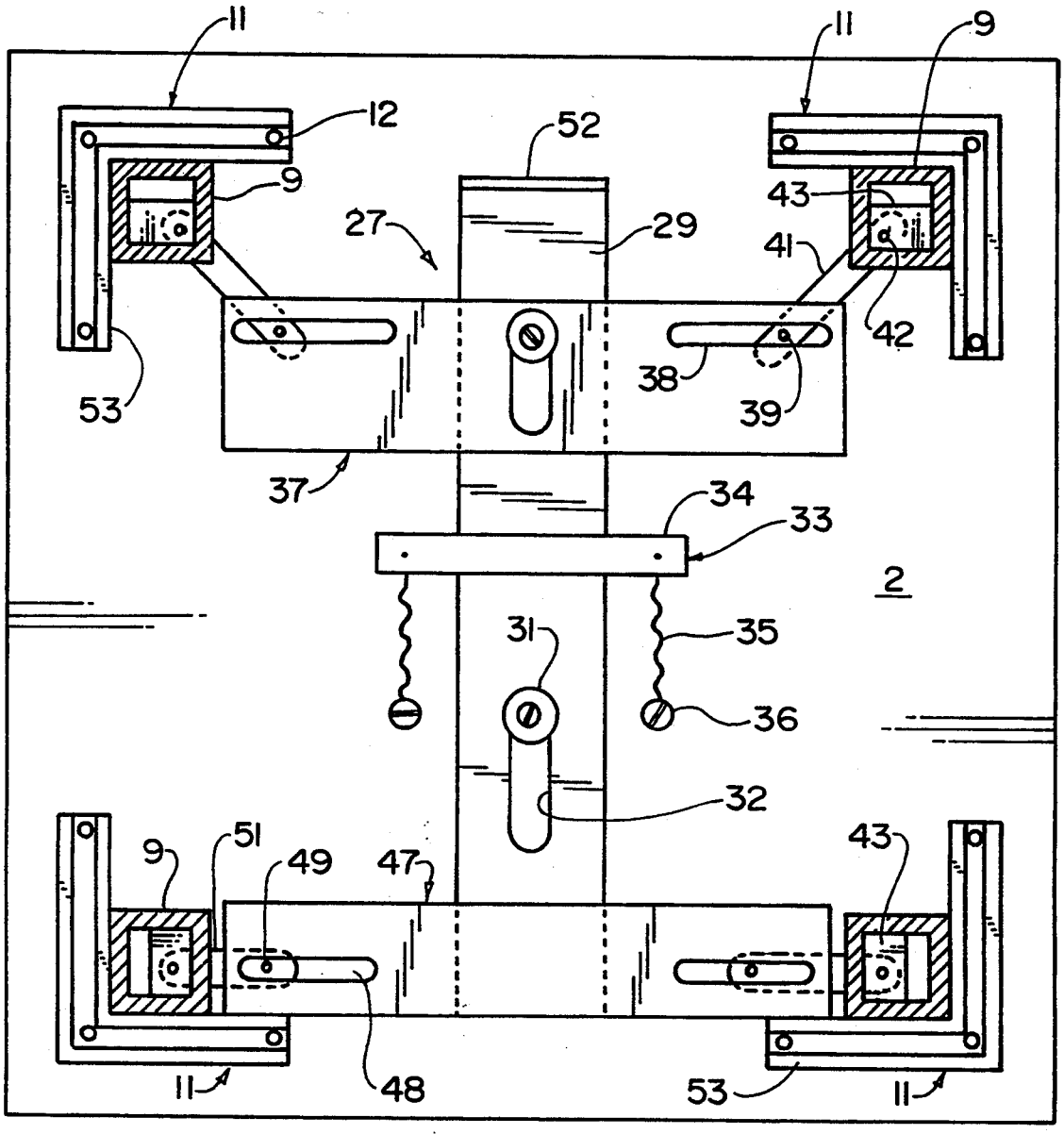
FIG. 3 is a section on line 3—3 of FIG. 1 showing the manually actuable means at the underside of the tabletop for effecting a locked and an unlocked condition of the legs of the unit.
Figure 4:
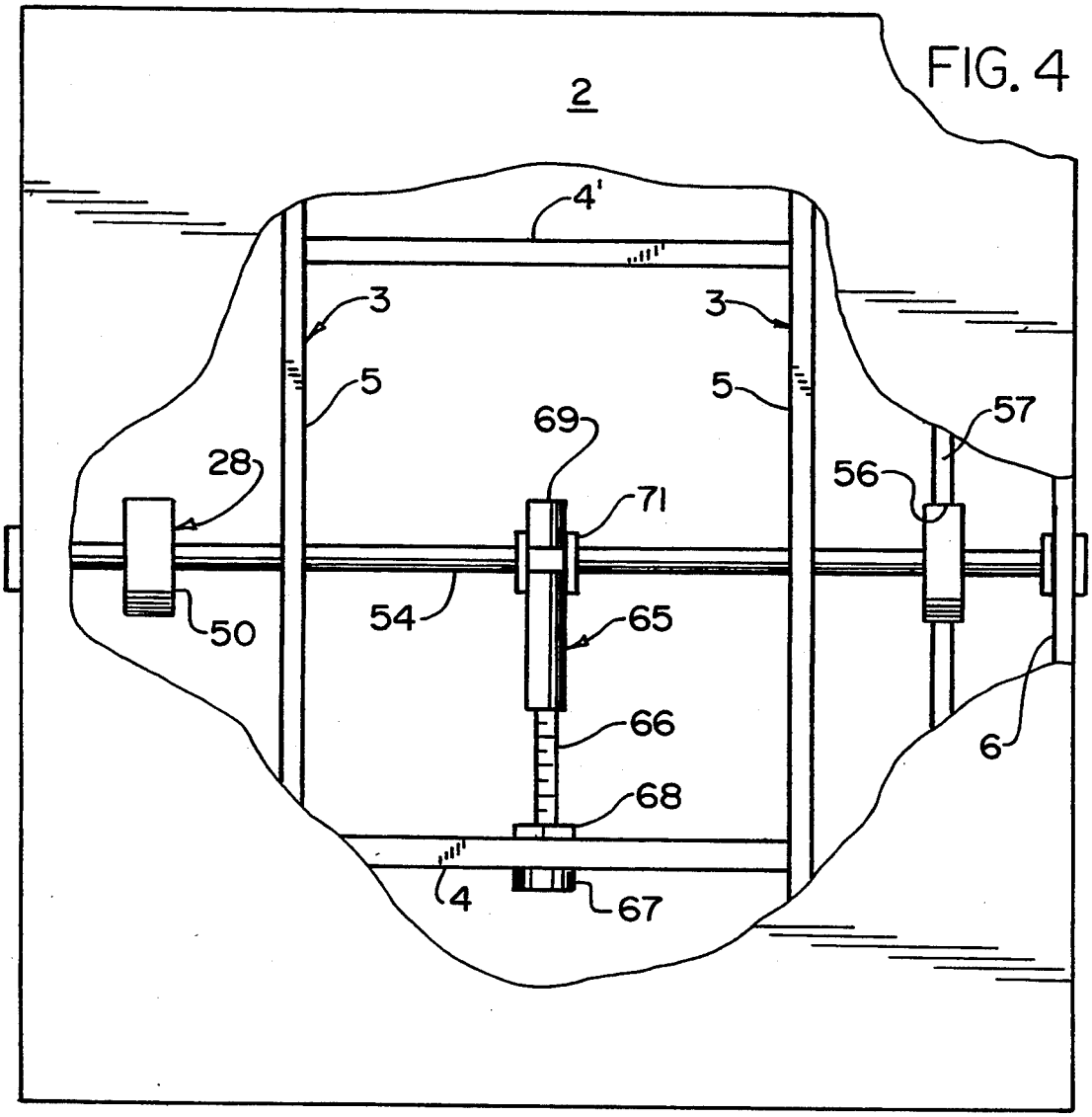
FIG. 4 is a plan view of the tabletop showing through a cutaway the disposition of the leg camming means in the block footings of the unit.

A table embodying the invention as described herein and as illustrated in the accompanying Figures of the drawing is a unitary structure. It has a base 1 upon which a rectangular tabletop 2 is supported and is adjustably movable relative to the base to selectable levels.

The base comprises a pair of narrow oblong floor standing hollow footings or blocks 3 as its sides, which sides are bridged in lateral parallel spaced relation to each other by rails 4, 4'. Each block includes a rectangular inner side panel 5 held in parallel spaced relation to a rectangular outer side panel 6 by relatively narrower end walls 7, Fixed to and extending vertically of each of the end walls 7 is a leg guide tube 8 (FIGS. 1, 2, 6) defining a vertical channel that is square in cross-section. The guide tubes define four corners of the base.

The tabletop 2 is a flat surfaced rectangular panel mounted at the underside of its four corners upon four legs 9 (FIGS. 1,3), each of which legs is tubular and square in cross-section. Each leg is fastened to a separate corner of the underside of the tabletop by means of a L-plate 11, which plate is fixed about an upper corner of the leg and is secured by fasteners 12 to the underside of the tabletop.

Each leg depends into and is guided for vertical gliding movement in the channel of a separate one of the guide tubes 8 of the base 1. To provide a smooth and stabilized movement of a leg relative to the guide tube, wheels 13 are mounted in the walls of the leg. The wheels are adapted to roll over opposed inner wall surfaces of the guide tube as the leg moves up or down the tube.

Movable vertically within the hollow interior of each block 3 is an elongated tray 14 (FIG. 2). The tray has at each of its ends an upright ear 15 which bears upon the adjacent wall of a guide tube 8 of the block. The ears are bridged by a rod 16. The rod is connected in the vicinity of each of its ends by a cable 17 extending over a pulley 18 (FIGS. 6,7) to a separate one of the legs in the related block. The cable extends over the pulley and down into the interior of the related guide tube 8 where it is fixed, as at 19, to a wall of the leg within the guide tube.

Each pulley is fixed up upon a shaft 22 in the trough of a U-member 21. The shaft is fixed to and projects through the sidewalls the U-member. The U-member is located between the sidewalls of a channel member 23, and it is pivotable relative to the channel member on its shaft 22, which shaft projects through lateral slots 24 in the sidewalls of the channel member 23. The channel member is an inwardly projecting extension of a rear channel section 25, which section sleeves the vertical related guide tube 8 and is fixed together with the guide tube to the inner face of the endwall 7 of the related block 3.

Each of the trays 14, as indicated by the tray shown in FIG. 2, is adapted to have elongated panel weights 26 piled into it. When the downward load of the weighted trays exceeds the counter-weight of the four legs and the machine laden tabletop, the legs and the tabletop will be raised relative to the base 1 by the downward movement of the pulley cable connected trays. And, when a reverse condition exists, the tabletop 2 will be drawn down to reseat relative to the base 1.

In making use of a table embodying the invention, the trays 14 are normally loaded with weights overbalancing the downward counter-pressure of the machine laden tabletop. But manually operable locking means 27 (FIGS. 3, 1) is provided to hold the tabletop locked against upward travel relative to the base 1 by such counter-pressure until it is desired for such movement. And, to avoid any abrupt upward travel of the machine laden tabletop when the locked condition is released, manually operable camming means 28(FIGS. 2,4,6,7) is provided within the hollow interior of each block 3 to effect a slow upward movement of the related legs and tabletop.

The locking means 27 (FIGS. 3,1) includes a manually slidable flat pull-panel 29, which is mounted by means of washer headed screws 31 for sliding movement relative to the underside of the tabletop 2. The shanks of the screws extend freely through longitudinally extending slots 32 in the pull-panel and are entered into the underface of the tabletop. Fixed to and extending across the mid-area of the underface of the pull-panel is a strip 33, downwardly inclined ends 34 of which project beyond the sides of the pull-panel and are connected by a pair of springs 35 to screws 36 entered into the underface of the tabletop. The pull-panel is biased by the springs rearwardly of the tabletop to a normal position in which forward ends of the slots 32 limit against the screws 31, as appears in FIG. 3.

Fixed to and extending across a forward underface of the pull-panel is an elongated flat strip 37 (FIGS. 3,1) which is connected at one end by means of a slot 38 and a pin 39 to a link 41. An opposite end of the link is fixed to the top of a leg locking shaft 42. The shaft depends slidably through a bore in a plug 43 entered into an upper end of one of the forward legs 9 of the tabletop. The shaft depends below the plug, and it is fixed at its bottom end to a locking key 44. The key is offset from the shaft and has a normal condition in which it projects through a horizontal slot 45 in the related leg into locking engagement with one of a plurality of slots 46 in the wall of the guide tube 8. An opposite end of the strip 37 is similarly associated with the opposite forward leg of the tabletop. The slots 46 in the guide tubes 8 are spaced in parallel relation above one another, and are subject to being lockingly engaged by the keys 44 as the forward legs are raised upwardly relative to the guide tubes 8.

Fixed to and extending across a rear underface area of the pull-panel 29 (FIG. 3) in parallel relation to the forward strip 37 is a second elongated flat strip 47. This strip is connected at each of its ends by means of a slot 48 and a pin 49 with a separate link 51. Each of the links 51 is associated, in the manner of the link 41, with a similar shaft 42 and locking key means 44 in the related leg 9.

The pull-panel 29 terminates in a depending shoulder 52 at its front end, whereby it may be manually pulled forwardly relative to the screws 31 and slots 32 to effect an unlocked condition of the four legs 9. In this respect, when the pull-panel is pulled forwardly relative to the screws 31, the rear and forward links 51, 41 are slid along the related slots 48, 38 to cause turning of the related shafts 42 in the four legs and drawing of the keys 44 out of locking engagement of the legs with the four guide tubes 8 of the base 1. Depending shoulders 53 along the edges of the L-plates 11 serve to provide a clearance between the underside of the tabletop and the surface of the base 1, whereby the pull-panel and the associated strips 37, 47 are free to slide relative to the underside of the tabletop when the tabletop is seated upon or closely above the base 1 of the table unit.

Now, while the legs are being held in the unlocked condition, the weighted trays 14, which normally overweigh the machine laden tabletop, will move downward in the blocks 3 of the base 1 and will act through the cable and pulley connections 17, 18 to pull the tabletop upwards. When the tabletop has risen to a selected desired level and the operator has released the pull-panel 29, the springs 35 will contract to return the pull-panel to its normal position and cause a return of the keys 44 into a locked condition with the raised legs and the guide tubes.

The camming means 28, which serves to effect a slow raising of the legs and tabletop from a locked condition, includes a supporting shaft 54 (FIG. 4) which extends crosswise of the base 1 through upper mid-areas of the sidewalls 5, 6 of both blocks 3. The shaft is supported by the sidewalls for relative rotation. Mounted within each block 3 upon the shaft is a cam 50, the peripheral surface of which provides a pair of opposed cam surfaces 55 (FIG. 2). Each of the cam surfaces abuts the inner end 56 of a separate pressure rod 57. The pressure rods extend in opposite directions and are supported for sliding movement by wall flanges 58. The outer ends 59 of the pressure rods project through holes in back walls 20 of the channel members 23 of the block into abutment with the backs of the pulley supporting U-members 21 so as to abut the ends 61 of the U-members against the guide tubes 8.

Each cam 50 turns as a unit with the shaft 54. As each cam turns in a block 3, its cam surfaces 55 ride against the inner ends 56 of the opposed pressure rods 57. This causes the outer ends 59 of the pressure rods to pressure and pivot the pulley supporting U-members 21 to press the pulleys 18 through upper slots 30 in the guide tubes 8 against opposed walls of the legs 9 in the block.

Friction pads 63 mounted to the upper backs of the legs project through back openings 60 in the tubes 8 and bear upon the inner faces of the end walls 7. The pressure of the pulleys upon the legs, together with the friction pads, serves to slow upward movement of the legs upon a release of the legs from a locked condition.

Figure 6:
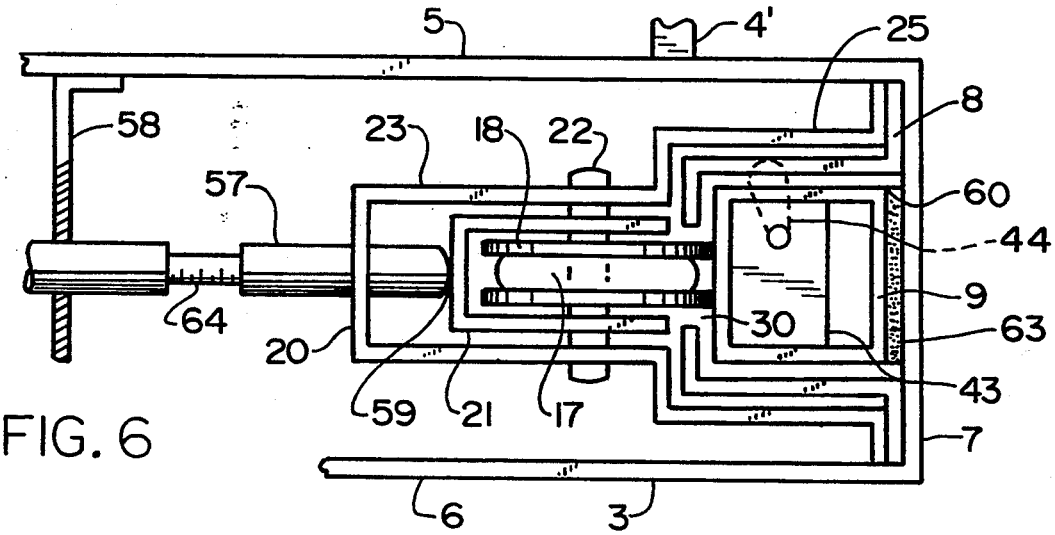
FIG. 6 is an enlarged detail view from the top of one end of one of the block footings of the unit and directed to showing the disposition of the pulley and cable to one of the legs, similar views of the ends of both block footings would be the same.

Further, the camming means 28 is subject to adjustment so as to control to a fine degree the extent of pressure exerted upon the legs to slow their elevating movement. To enable this, each pressure rod in a block 3 comprises two sections connected to each other by an intermediate threaded section 64 (FIGS. 2, 6). The length of the rods may be adjustably varied by threading the sections relative to each other to obtain a condition in which the pressure exerted upon the U-members 21 progressively increases as the cam surfaces ride over the ends of the pressure rods. Following this initial adjustment, actuation of both cam members 50 against the pressure rods until a precise desired pressure is obtained is enabled by manually operable linkage 65 (FIGS. 4,5) connected to the cam shaft 54.

The linkage 65 comprises an elongated micro-threaded screw 66 which projects at its front end freely through a hole in the front rail 4 of the base 1. A knob head 67 of the screw bears upon the outer face of the rail 4, and a nut 68 fixed upon the screw bears upon the inner face of the rail whereby the screw is restrained against endwise movement but is free to rotate. The opposite end of the screw is threaded into an elongated tube 69 which extends between the upright sides of a U-piece 71. The latter is fixed to and depends from the mid-section of the cam shaft 54. The ends of a pin 72 projecting from the sides of the tube extend freely through vertical slots in the sides of the U-piece. Manual turning of the knob 67 in one direction or the other will through the screw 66 and the tube 69 pivot the U-piece to cause a corresponding turning of the cam shaft 54. And, according to the direction and extent of the turning of the cam shaft, the degree of pressure exerted by the cams 50 through the pressure rods upon the legs 9 will be determined. Due to the micro-threading of the screw 66 the degree of pressure exerted by the cams upon the legs may be micro-controlled, that is, very fine.

While an embodiment of the invention has been illustrated and described in detail, it is to be expressly understood that the invention is not limited thereto, and it is my intent, therefore, to claim the invention not only as shown and described but also in all such forms and modifications thereof as may be reasonably construed to fall within the spirit of the invention and the scope of the appended claims.

What is claimed is:

1. A table unit having a tabletop movable to selectable levels comprising a floor standing base having a pair of oblong hollow blocks as its sides joined in parallel spaced relation to each other by crossrails, each block having a vertical tube mounted to the inner face of a front wall of the block and having a similar tube mounted to an opposite inner face of a rear wall of the block, a rectangular tabletop disposed above the base and having at each of its corners a leg registering with and depending slidably into the tube at the related corner, an elongated tray disposed in each block between the tubes of the block, each tray being tied at one of its ends by a first cable that extends over a first pulley that is supported within the block to the front wall of the block and which cable is engaged at its opposite end to the leg depending into the tube at the front wall, each tray being tied at its opposite end by a second cable that extends over a second pulley that is supported within the block to the rear wall of the block and which cable is engaged at its opposite end to the leg depending into the tube at the rear wall of the block, and each tray being loaded equally with weights sufficient for the total weight of both trays to overbalance the weight of the tabletop and legs so as to raise the tabletop and legs by the cables and pulleys through selectable levels.

2. A table unit as in claim 1, wherein manually operable lever means is associated with the legs and related tubes for locking the legs and tabletop against movement by the overbalancing weight of the trays above a level selected.

3. A table unit as in claim 2, wherein a friction pad is mounted in each tube to a back wall of the leg in the tube, the friction pad projects through a rear opening in the tube and bears against an inner opposed wall area of an end wall of the block, camming means is provided in each block abutting an upper wall area of each leg opposite to the back wall of the leg, and manipulative means is provided connected to the camming means in both blocks for actuating the camming means to exert a pressure upon the legs slowing upward travel of the legs following a release of the locking means.

4. A table unit as in claim 3, wherein the manipulative means includes a shaft upon which the camming means of both blocks is mounted and which shaft is turnable for actuating the camming means of both blocks as a unit, and manually operable means is connected with the shaft for turning the shaft.

5. A table unit as in claim 4, wherein the manually operable means includes linkage connected with the shaft for determing the degree of turning of the shaft in either direction and the linkage includes an arm that is fixed at an upper end to the shaft and depends from the shaft, and a manually rotatable screw having a micro-threaded engagement with a fitting connected to a lower end of the arm whereby rotation of the screw serves to move the arm and shaft angularly according to the degree that the screw is rotated in one direction or the other.

6. A table unit having a tabletop movable to selectable levels comprising: a floor standing base having a pair of oblong hollow blocks as its sides joined in parallel lateral spaced relation to each other by crossrails, each block having a vertical fore tube mounted within the block to a front wall of the block and having a similar rear tube mounted within the block to an opposite rear wall of the block, a rectangular tabletop disposed above the base and having at each of its corners a leg registering with and depending slidably into a separate one of the tubes, a separate elongated weight receiving tray disposed in and vertically slidable in each block between the fore and rear tubes, a pair of pulleys supported in each block above the tray, a pair of cables within each block, of which cables one cable connects a fore end of the tray over one of the pulleys with the leg slidable in the fore tube, and the other cable connects a rear end of the tray over the other pulley with the leg slidable in the rear tube, panel weights received in each tray effecting a condition overbalancing the weight of the tabletop and legs so as to cause elevation of the tabletop and its legs relative to the base through selectable levels by movement of the weighted cables over the pulleys, and manually operable lever means movable with the legs for locking the legs to the tubes against movement above a selected level by the overbalancing weight of the trays.

7. A table unit as in claim 6, wherein camming means is associated with the legs for retarding vertical movement of the legs relative to the tubes, and manually operable means is connected for effecting operation of the camming means.

* * * * *